US007282019B2

(12) United States Patent
Lantz

(10) Patent No.: US 7,282,019 B2
(45) Date of Patent: Oct. 16, 2007

(54) CENTRIFUGE WITH SHAPING OF FEED CHAMBER TO REDUCE WEAR

(76) Inventor: Edward Carl Lantz, 31049 Coyote Valley Road, N.W., Calgary, Alberta (CA) T3L 2R1

( * ) Notice: Subject to any disclaimer, the term of this patent is extended or adjusted under 35 U.S.C. 154(b) by 36 days.

(21) Appl. No.: 11/114,223

(22) Filed: Apr. 26, 2005

(65) Prior Publication Data

US 2006/0240966 A1 Oct. 26, 2006

(51) Int. Cl.
*B04B 1/20* (2006.01)

(52) U.S. Cl. ..... 494/54; 494/53

(58) Field of Classification Search ..... 494/52–54, 494/56, 84; 210/377, 380.1, 380.3
See application file for complete search history.

(56) References Cited

U.S. PATENT DOCUMENTS 2,703,676 A * 3/1955 Gooch ..... 494/42
3,096,282 A * 7/1963 Trotter, Jr. ..... 494/45
3,228,592 A * 1/1966 Shapiro ..... 494/51
3,398,888 A * 8/1968 Koenecke et al. ..... 494/11
3,428,246 A * 2/1969 Finkelston ..... 494/27
3,568,920 A * 3/1971 Nielsen ..... 494/53
5,354,255 A * 10/1994 Shapiro ..... 494/53
5,364,335 A * 11/1994 Franzen et al. ..... 494/15
5,374,234 A * 12/1994 Madsen ..... 494/53
5,380,266 A * 1/1995 Leung et al. ..... 494/53
5,401,423 A * 3/1995 Leung et al. ..... 210/787
5,403,486 A * 4/1995 Leung ..... 210/512.1
5,423,734 A * 6/1995 Leung ..... 494/53
5,520,605 A * 5/1996 Leung et al. ..... 494/50
5,527,258 A * 6/1996 Leung et al. ..... 494/53
5,527,474 A * 6/1996 Leung ..... 210/787
5,551,943 A * 9/1996 Leung et al. ..... 494/53
5,658,232 A * 8/1997 Leung ..... 494/50
5,683,343 A * 11/1997 Leung ..... 494/52
5,769,776 A * 6/1998 Leung et al. ..... 494/53

(Continued)

FOREIGN PATENT DOCUMENTS

DE 2057555 * 6/1972

(Continued)

*Primary Examiner*—Charles E. Cooley
(74) *Attorney, Agent, or Firm*—Adrian D. Battison; Michael R. Williams; Ryan W. Dupuis

(57) ABSTRACT

A centrifuge of the type having an outer bowl and an inner rotor both of which are generally cylindrical and rotate in the same direction but at slightly different rates separates slurry fed into the interior of the rotor into solids and liquid. An auger flight on the outside surface of the rotor carries the solids along the annular channel between the outside of the rotor and the inside of the bowl. The slurry is fed into a chamber at one end of the rotor and through outlet holes in the sides of the rotor into the channel. An end plate of the chamber has a forwardly projecting domed central nose which extends into the flowing slurry. Transverse guide plates of the rotor act to engage the slurry and accelerate it into rotation with the rotor before escaping through the holes. The guide plates are shaped with curved angularly projecting ribs on the downstream side in front of the hole over which the slurry flows in a smooth path before exiting the hole.

13 Claims, 4 Drawing Sheets

U.S. PATENT DOCUMENTS

| | | | | |
|---|---|---|---|---|
| 5,840,006 | A * | 11/1998 | Leung et al. | 494/53 |
| 5,971,907 | A * | 10/1999 | Johannemann et al. | 494/37 |
| 6,077,210 | A * | 6/2000 | Leung et al. | 494/53 |
| 6,561,965 | B1 * | 5/2003 | Corner-Walker et al. | 494/53 |
| 6,605,029 | B1 * | 8/2003 | Koch et al. | 494/53 |
| 6,780,147 | B2 * | 8/2004 | Koch et al. | 494/53 |
| 6,790,169 | B2 * | 9/2004 | Koch et al. | 494/53 |
| 7,001,324 | B2 * | 2/2006 | Hensley et al. | 494/53 |
| 7,018,326 | B2 * | 3/2006 | Koch et al. | 494/53 |
| 7,060,019 | B2 * | 6/2006 | Hermeler et al. | 494/53 |
| 2004/0029697 | A1 * | 2/2004 | Hermeler et al. | 494/53 |
| 2004/0167005 | A1 * | 8/2004 | Hensley et al. | 494/53 |
| 2005/0245381 | A1 * | 11/2005 | Tettleton et al. | 494/53 |
| 2006/0240966 | A1 * | 10/2006 | Lantz | 494/54 |

FOREIGN PATENT DOCUMENTS

| | | | |
|---|---|---|---|
| DE | 3723864 | A1 * | 1/1989 |
| DE | 4041868 | A1 * | 7/1992 |
| GB | 1053222 | * | 12/1966 |
| JP | 54-139167 | * | 10/1979 |
| JP | 2-160063 | * | 6/1990 |
| JP | 2004-290832 | * | 10/2004 |
| JP | 2004-290833 | * | 10/2004 |

* cited by examiner

CENTRIFUGE WITH SHAPING OF FEED CHAMBER TO REDUCE WEAR

This invention relates to a centrifuge.

BACKGROUND OF THE INVENTION

Centrifuges have many different types and the present invention is concerned with the two phase centrifuge type which provides high speed horizontal decanting that separate solids from liquids. Centrifuges of this type have been manufactured by United Oilfield Inc., who are assignees of the present application for a number of years and each includes three primary parts which are the base or skid, the stainless steel case mounted on the skid and the rotating assembly consisting of the bowl, auger and gearbox which assembly is mounted in the stationary steel case on the skid. The auger is mounted in the bowl so that the bowl surrounds the auger and both are mounted for coaxial rotation about a longitudinal axis. The auger comprises generally a cylindrical body coaxial to the cylindrical bowl with an auger flight on its outer surface which has an edge close to the inside surface of the cylindrical bowl.

To create the desired effect, the bowl with the auger inside rotates about the axis at slightly different speeds in the same direction. The bowl speed is variable depending upon the application and operating conditions.

During operation, feed slurry is fed from an axially extending stationary feed pipe at one end of the auger into a feed chamber at that end of the auger through an end wall of the bowl. The flowing slurry strikes an accelerator plate in the auger at one end of the feed chamber and is forced from the feed chamber outwardly into the bowl.

Centrifugal force causes heavier solids to accumulate on the inside surface of the bowl. The auger, which is rotating with the bowl but at a slow speed relative to the bowl, acts to continuously drag them axially along the bowl. Each of the bowl and the auger includes a tapered end portion at the feed end which converges radially inwardly toward a discharge end of the bowl, which is at the same end as the feed end. The rotation of the bowl and its tapered end tends to move the heavier material axially away from the discharge end to the cylindrical section of greater diameter. Thus the auger drags the material along the tapered section toward the discharge end. The discharge end includes discharge ports surrounding the feed duct so that the heavier solid material when it reaches the discharge end is discharged outwardly by the centrifugal force into the case for collection.

Finer solids are retained in the liquid traveling through the bowl away from the feed end to the remote end but are deposited on the wall of the bowl and are continuously removed as they build-up inside the bowl by the action of the auger and out the solids discharge ports.

Clean fluids travel towards the remote fluid end of the bowl and exit through adjustable eccentric ports at the remote fluid discharge end of the bowl. The centrifuge is commonly but not exclusively used for mud systems in drilling where the mud is re-circulated through the drill string to extract drilling solids so that the solids can be extracted in the centrifuge and the clean fluid from the centrifuge can be recycled back into the mud system of the operation.

The greatest difficulty in achieving optimal performance in a centrifuge of this type is wear caused by the combined corrosive nature of flow pressure and the abrasive solids on the steel structure of the centrifuge.

SUMMARY OF THE INVENTION

It is one object of the invention to provide an improved centrifuge of this general type.

According to one aspect of the invention there is provided a centrifuge of the above general type where the end accelerator plate lying generally in a radial plane of the axis such that the slurry flowing generally axially into the feed chamber contacts the accelerator plate of the rotor and moves radially outwardly therefrom through the at least two outlet openings into the space;

the end accelerator plate is connected to the outer wall of the rotor at an end edge of each of the at least two outlet openings in the outer wall;

the is provided at least two discharge surfaces within the feed chamber, each discharge surface having first and second end edges connected to the outer wall;

the discharge surfaces each being arranged generally at right angles to the end accelerator plate;

with the first edge of a respective one of the discharge surfaces being located at and connected to the first edge of a respective one of the outlet openings in the outer wall and with the second edge of the respective one of the discharge surfaces being located at and connected to the second edge of the next outlet opening in the outer wall so that the respective one of the discharge surfaces bridges a space therebetween;

wherein the auger flight has a pitch spacing at a portion of the outer wall of the rotor at the outlet openings which is greater than a pitch spacing at an end of the rotor remote from the slurry inlet opening, According to a second aspect of the invention there is provided a centrifuge of the above general type where the rotor has a first and a second angularly spaced outlet opening defined in the outer wall at diagonally opposed positions around the axis each communicating with the feed chamber to allow the slurry to exit through the outer wall from the feed chamber into the space;

the first and second outlet openings each having a first side edge and a second side edge with the first and second side edges being generally parallel to each other and to the axis;

the rotor having an end accelerator plate of the feed chamber mounted within the outer wall of the rotor for rotation therewith;

the end accelerator plate lying generally in a radial plane of the axis such that the slurry flowing generally axially into the feed chamber contacts the accelerator plate of the rotor and moves radially outwardly therefrom through the first and second outlet openings into the space;

the end accelerator plate being connected to the outer wall of the rotor at an end edge of each of the first and second outlet openings in the outer wall;

each of the first and second outlet openings having a first edge and a second edge so as to define a first imaginary plane joining the first edge of the first outlet opening and the second edge of the second outlet opening and a second imaginary plane joining the second edge of the first outlet opening and the first edge of the second outlet opening;

the being provided a first and a second discharge surfaces within the feed chamber, each discharge surface having first and second end edges connected to the outer wall;

the first and second discharge surfaces each being arranged generally at right angles to the end accelerator plate;

with the first edge of the first discharge surface being located at and connected to the first edge of the first outlet opening in the outer wall and with the second edge of the first discharge surface being located at and connected to the second edge of the second outlet opening in the outer wall so that the first discharge surface bridges a space therebetween;

with the first edge of the second discharge surface being located at and connected to the second edge of the first outlet opening in the outer wall and with the second edge of the second discharge surface being located at and connected to the first edge of the second outlet opening in the outer wall so that the second discharge surface bridges a space therebetween;

the first discharge surface being shaped relative to the first imaginary plane such that a portion of the first discharge surface, which portion extends along the second outlet opening and which portion lies adjacent the second edge of the second outlet opening, extends outwardly from the first imaginary plane toward the second imaginary plane;

the second discharge surface being shaped such that a portion of the second discharge surface, which portion extends along the first outlet opening and which portion lies adjacent the second edge of the first outlet opening, extends outwardly from the second imaginary plane toward the first imaginary plane;

wherein the portion of the first discharge surface has an apex which is at a maximum spacing from the first imaginary plane where the apex is spaced from the second edge of the second outlet opening and the surface tapers back toward the first imaginary plane as it approaches the second edge;

the portion of the second discharge surface has an apex which is at a maximum spacing from the second imaginary plane where the apex is spaced from the second edge of the first outlet opening and the surface tapers back toward the second imaginary plane as it approaches the second edge;

wherein the portion of the first discharge surface is smoothly curved in cross-section taken in a radial plane of the axis;

and wherein the portion of the second discharge surface is smoothly curved in cross-section taken in a radial plane of the axis.

Preferably the portion of the discharge surface is smoothly curved in cross-section taken in a radial plane of the axis.

Preferably the portion of the discharge surface has an apex which is at a maximum spacing from the imaginary plane where the apex is spaced from the leading edge and the surface tapers back toward the imaginary plane as it approaches the leading edge.

Preferably the portion of the discharge surface where the surface is retarded has a width in the direction between the leading edge and the trailing edge which extends about half way across the imaginary plane.

Preferably each discharge surface is shaped, relative to the imaginary plane, such that a portion of the discharge surface adjacent the trailing edge of said one of the outlets lies generally in the imaginary plane. This forms a sharp edge at the junction with the wall of the rotor which can better engage the slurry within the rotor.

Thus the accelerator plate is dominated by a "striker nose" that protrudes into the feed chamber. This adaptation can operate to eliminate splash-back, positions the flow, increases optimal performance of the auger, and minimizes wear by forcing the solids to wear onto other solids and avoid wearing on steel.

In addition, the slurry passes over the base of the feed chamber which has been re-designed with a curved surface to facilitate easier movement of solids and to make the area more resistant to wear. This area has been accentuated to easier facilitate flow. By building up the height of the discharge edge or trailing edge of the feed chamber and giving it a slope, a path of least resistance is achieved.

After passing through the feed chamber, the slurry strikes an accelerator plate and is forced into the bowl. The accelerator plate has been designed to more readily force the materials into the bowl for separation.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
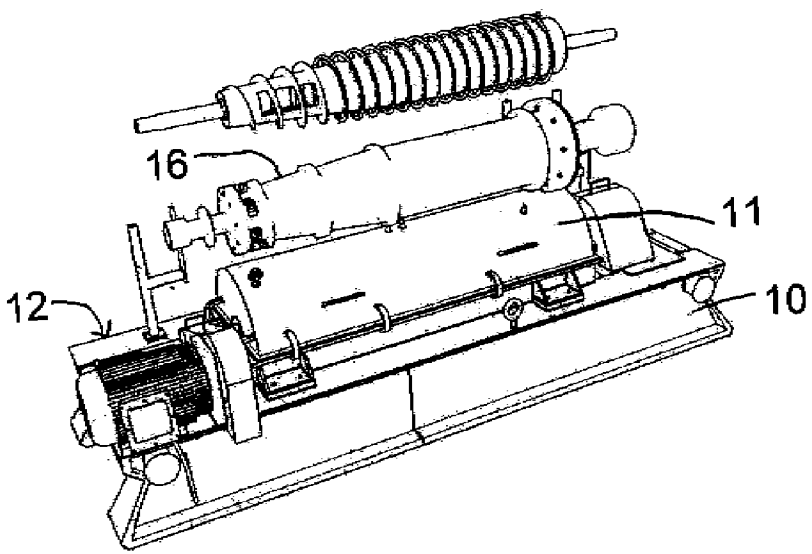
FIG. 1 is a partly schematic exploded view of a centrifuge according to the present invention.

In FIG. 1 is shown schematically a centrifuge of the type with which the present invention is concerned. Centrifuges of this type have been manufactured for a number of years by the present assignee and details of the general construction of this centrifuge is well known to one skilled in the art.

The centrifuge generally comprises a base skid 10 on which is mounted on a fixed housing 11. The housing can be opened to access the interior of the housing and the elements therein. At one end of the housing is provided a motor and gear box arrangement schematically indicated at 12 which provides drive to the components inside the housing 11. At the other end of the housing is provided a feed duct 13 for supply of slurry from a source 14 through a duct 15.

Within the fixed housing 11 is provided an outer bowl 16 having a peripheral wall 17 with an inside surface 18. The bowl is mounted for rotation about a longitudinal axis 19 so that the inside surface of the peripheral wall rotates around the axis providing a centrifugal force against the inside surface. The bowl is elongate along the axis 19 so as to provide a first end 20 and a second end 21. The first end 20 is generally a feed end so that the slurry from the source 14 is fed in through the duct 13 which passes through an opening 22 in the end 20 for entry into the interior of the bowl. The second end 21 is a discharge end for the slurry and includes holes 24 through which the slurry can pass after separation of liquid from heavier particles so that the particles are generally collected within the bowl allowing the liquid component to escape through the holes 24 for collection within the housing 11.

Inside the outer bowl 16 is provided a rotor 25 which is shaped to follow generally the inside surface 18 of the bowl so that the rotor also has a first end 26 adjacent the end 22 of that bowl and a second end 27 adjacent the end 21 of the bowl. The rotor also has an outer wall 28 which follows the general shape of the inside surface 18 but is spaced radially inwardly therefrom so as to define an annular space 30 along the length of the rotor and along the length of the bowl. The space 30 defines a duct through which the slurry can pass while the centrifugal action separates the particles onto the inside surface of the bowl while the liquid component tends to move along the bowl toward the discharge end 21.

The motor and gear box 12 acts to drive the bowl through a first coupling 12A and acts to drive the rotor through a second coupling 12B. These are shown co-axial but this is merely schematic and suitable gear box arrangements are well known to one skilled in the art to provide this driving arrangement.

In particular the motor and drive arrangement 12 acts to drive the bowl and the rotor in a common rotation direction while providing a relatively small differential between the angular velocity of the bowl and the angular velocity of the rotor. This relatively small differential causes the outside surface of the wall 28 to move relatively slowly in comparison with the common angular velocity, relative to the inside surface 18 of the peripheral wall of the bowl.

The wall 17 of the bowl has a cylindrical portion 17A extending from the end 21 to a position 17B, from which the wall 17 tapers radially inwardly toward the end 20. This forms a conical section 17C which is tapered radially inwardly. It will be appreciated therefore that the rotation of the bowl provides a force on materials on the portions 17C of the wall of the bowl tending to cause those materials to move axially toward the end 21 and away from the end 20.

The wall 28 of the rotor also includes a cylindrical portion 28A extending to a position 28B and includes a tapered portion 28C matching the taper 17C of the bowl.

On the outside surface of the wall 28 is provided an auger flight 32 which is wrapped helically around the outer surface of the wall 28 from the end 21 through to the end 20 including along the tapered section 28C. The flight is helically arranged at an angle such that the differential in angular rotation of the wall 28 relative to the bowl causes the auger flight to sweep material collecting on the inside surface 18 of the wall 16 along the wall 16 to the discharge end 20 where it can be discharged from the bowl as collected solids. It will be appreciated that the heavy solids collect on the inside surface 18 substantially immediately after the discharge into the space 30. Lighter solids flow along the space 30 through openings 33 in the flight 32 toward the discharge end 24 but continue to accumulate on the inside surface due to the centrifugal action on the particles. Such particles whenever they collect on the inside surface are then carried by the outside edge or ribbon of the flight along the wall to the end 20 of the bowl where they are discharged into the housing for collection in a suitable launder (not shown).

The duct 13 extends into the open end of the rotor at the end 26. Thus the slurry enters into the hollow interior of the rotor and flows along the interior up to a closure plate 35 which bridges across the interior of the rotor and halts the further forward flow of the slurry. Two radially opposed holes 36A and 36B are provided in the outside wall of the rotor in the tapered section 28C for discharge of the slurry radially outwardly into the space 30.

Figure 2:
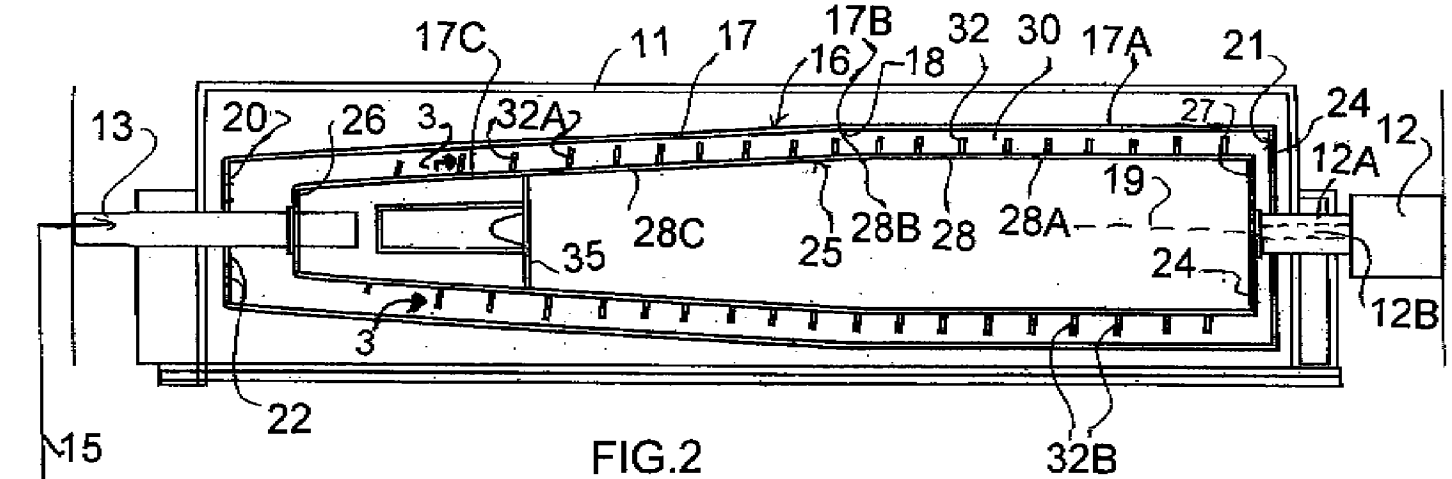
FIG. 2 is a partly schematic longitudinal cross sectional view of the centrifuge of FIG. 1.
Figure 3:
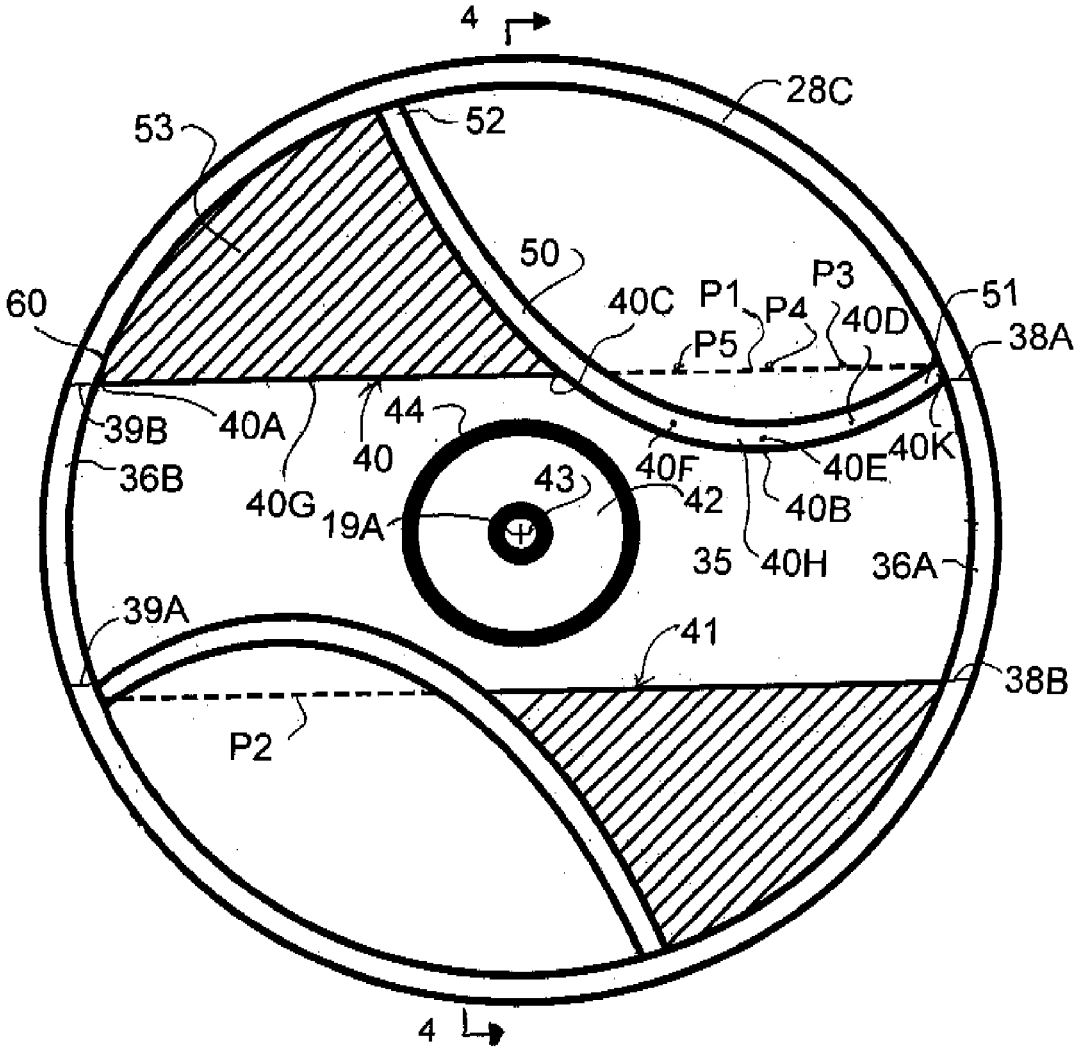
FIG. 3 is a cross sectional view along the lines 3-3 of FIG. 2.
Figure 3A:
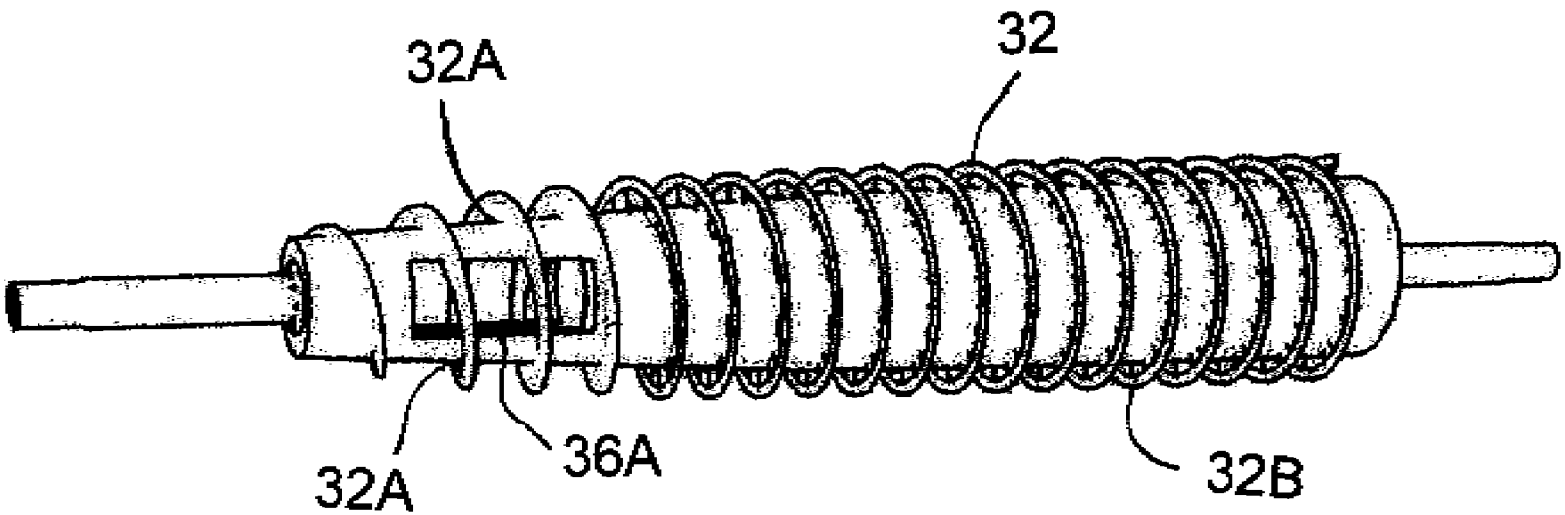
FIG. 3A is an isometric view of the rotor of FIG. 1 on an enlarged scale.
Figure 4:
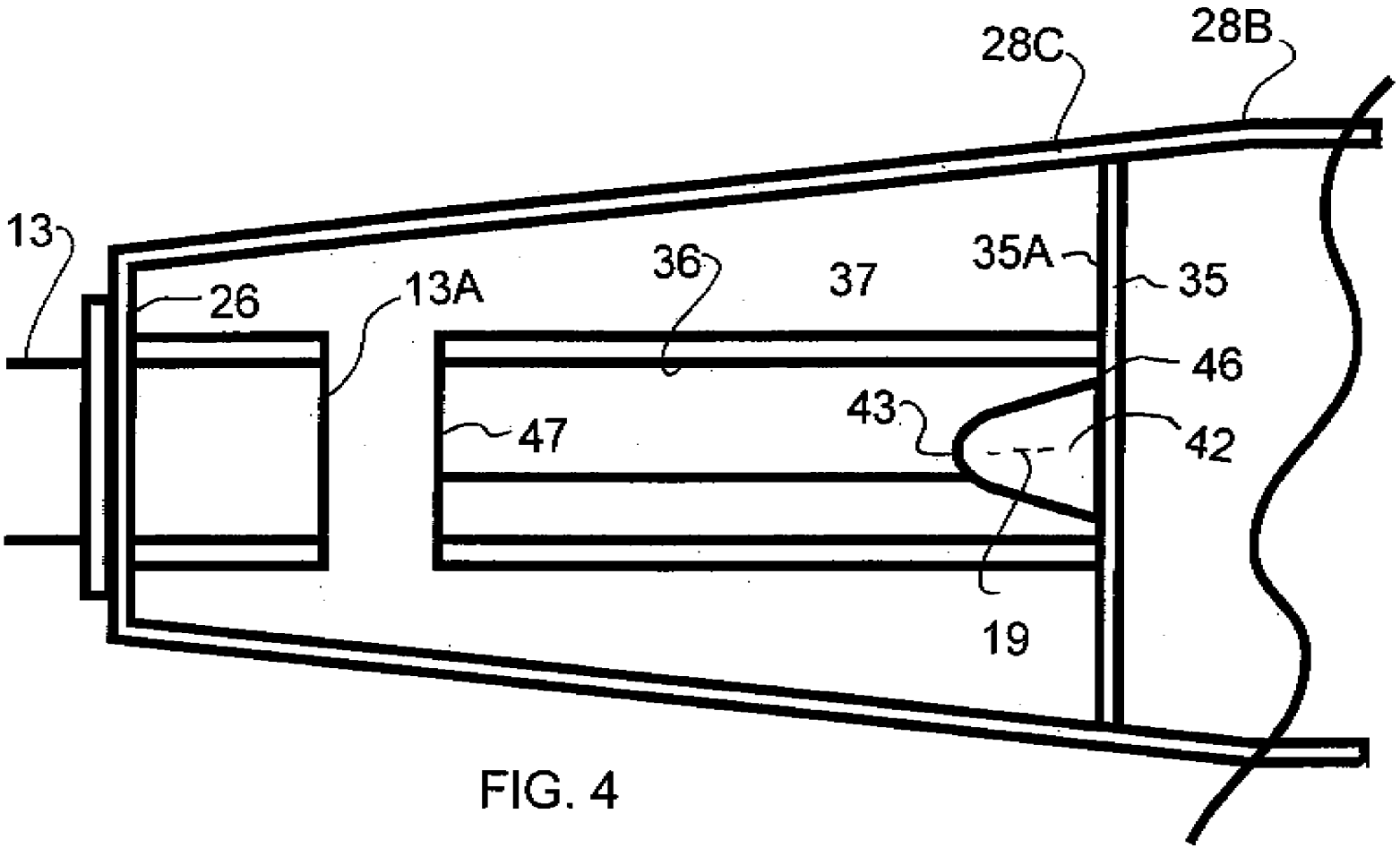
FIG. 4 is a cross sectional view along the lines 4-4 of FIG. 3.

Centrifuges of the above type are previously manufactured by the present assignee and the centrifuge of this type is modified in the area of the feed chamber 37 within the hollow interior between the end 26 and the acceleration plate 35. The feed chamber 37, the holes 36A and 36B and the acceleration plate 35 are shown on an enlarged scale and in more detail in FIGS. 3 and 4 which show the improvements of the present invention. Thus in FIG. 3 the wall 28C is shown which has two opposed discharge holes or openings 36A and 36B which are diametrically opposed relative to a center 19A on the axis 19. The hole 36A has a first edge 38A and a second edge 38B. The opening 36B has a first edge 39A and a second edge 39B again relative to the direction of rotation. The holes 36A and 36B are generally rectangular so that the leading and trailing edges are generally parallel and extend along the tapered section 28C. While the holes 36A and 36B are shown rectangular, they may indeed be tapered in view of the taper in the wall 28C so that the leading and trailing edges are not exactly parallel but converge together toward the end 26. As best shown in FIGS. 2, 3 and 4, the auger flight 32 has a pitch spacing at a portion 32A of the flight at the outer wall of the rotor at the outlet openings which is greater than a pitch spacing of a portion 32B of the flight at an end of the rotor remote from the slurry inlet opening 13. An imaginary plane is indicated at P1 which interconnects the first edge 38A with the second edge 39B. Symmetrically a plane P2 which again is imaginary interconnects the first edge 39A with the second edge 38B. These planes are defined merely for convenience of explanation of the shape and construction of a surface 40 which extends from the first edge 38A through to the second edge 39B. A symmetrical surface 41 extends from the leading edge 39A to the trailing edge 38B. These surfaces engage the material within the feed chamber 37. It will be appreciated that the surfaces 40 and 41 are rotating with the rotor at relatively high velocity while the slurry entering through the duct 13 is moving only in the axial direction. Thus the surfaces 40 and 41 together with the acceleration plate 35 act to engage the fluid within the feed chamber 37 so as to accelerate the fluid in its rotation around the axis 19 thus causing the fluid to move outwardly through the discharge holes 36A and 36B.

The plate 35 is generally flat and circular in plan so as to fill the interior of the rotor and define the end face of the feed chamber. The acceleration plate 35 is modified by the addition of a nose 42 which extends forwardly from the plate to an apex 43 spaced forwardly of the plate toward the end 26. The nose 42 is mounted on the axis 19 so as to be symmetrical about the axis. The nose has a circular edge 44 at the plate surrounding the axis 19. The nose is dome shaped so that it converges smoothly to the apex 43 with curved walls. The nose forms a wear member which projects into the flow of the fluid from the mouth 13A of the duct 13 so that the fluid tends to engage the nose at the apex and to spread around the surface 45 of the nose onto the plate 35 and its front surface 35A facing the fluid. The plate 35 is located at a downstream end 46 of each of the holes 36 with the holes extending with the parallel upper and lower edges to an upstream end 47 just beyond the mouth of the duct 13. Thus the material flowing onto the accelerator plate 35 and its nose 42 is halted at that location thus causing the material to flow outwardly through the holes 36A and 36B. As the material begins to flow outwardly, it is engaged by the surfaces 40 and 41 as best shown in FIG. 3. The surfaces are symmetrical so that only one of the surfaces will be described. Thus the surface 40 includes an end 40A commencing at the second edge 39B and from that end 40A it is flat extending to approximately a mid-point 40C. From that mid point it is curved outwardly toward an apex 40B. From that apex 40B, the surface 40 curves to a point 40D after which it reaches the plane P1. Thus it will be noted that each of a series of lines 40D, 40E, 40F are angularly displaced relative to points P3, P4, P5 lying in the plane P2. It will be appreciated that all of these points or lines are purely imaginary and are used merely for explanation of the shape of the surface. Thus the point P3 lies at a common radial distance from the center 19A with the point 40D with each of the further points corresponding in radial distance. It will be noted that in the whole of the area between the edge 40A and the point 40C, the lines in the surface are angularly displaced relative to corresponding lines within the plane P1. From the point 40C to the end 40A, the surface 40 is flat indicated at 40G. This provides on the surface 40 a rib 40H which is raised relative to the imaginary plane P1.

This shape is formed by providing a part cylindrical wall 50 with one edge 51 at the edge 40K and a second edge 52 attached to the wall 28C at a position behind the section 41G. Between the surface 40G and the point 52, the surface 41 is made up from a filler material indicated at 53. The filler material can be weld or other materials which are resistant to the highly abrasive action of the particles within the fluid in the chamber 37.

The shaping of the surface 40 such that it is domed in an outward direction at the end 40K assists in sweeping the material out of the opening 36B so that it flows more smoothly over the surface and out of the opening. In addition the curvature of the surface and the smooth flowing action of the materials over the surface reduces the wear on the surface 40. As set forth above, the surface 41 is exactly symmetrical so that it cooperates with the surface 40 as just described.

Thus the portion 40H of the surface 40 rotates into the stationary or only slowly rotating slurry and acts to engage this slurry and accelerate the slurry. The slurry then moves over the surface 40 toward its end 40K at the opening 36A. The part of the surface on one side of the mid point 40C is flat and thus the slurry slides across this surface portion. However the second part of the surface 40 between the mid point 40C and the end 40K is domed as the slurry begins to accelerate and move rapidly across this portion of the surface. This domed shape which extends outwardly relative to the plane P1 toward the second imaginary plane P2 and toward the second side edge 38B surprisingly allows smoother flow of the slurry with less wear on the surface caused by the highly abrasive slurry. At the end 40K the surface curves toward the plane P1 so that at the edge 38A of the opening 36B the slurry can simply slide off the surface 40 through the first edge 38A of the first opening 36A. It will be noted that the junction of the end 40A of the surface 40 with the wall 28C at the second edge 39B of the opening 36B provides a sharpened edge or nose 60 which can bite into the slurry and cause it to move away from this edge toward the end 40K of the surface 40.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A centrifuge for separation of particulates from a slurry containing the particulates in a liquid comprising:

an outer bowl having a longitudinal axis and a peripheral wall surrounding the axis, the peripheral wall extending from a first end of the bowl to a second opposed end of the bowl;

a first discharge arrangement at the first end of the bowl for discharge of the particulates;

a second discharge arrangement at the second end of the bowl for discharge of the slurry with the particulates removed;

a support assembly mounting the outer bowl for rotation about the longitudinal axis such that the particulates in the slurry within the bowl tend to move radially outwardly of the axis toward an inner surface of the peripheral wall;

an inner rotor mounted coaxially within the outer bowl for rotation of an outer wall of the inner rotor about the longitudinal axis, the rotor extending along the bowl from a first end of the rotor adjacent the first end of the bowl to a second end of the rotor adjacent the second end of the bowl;

a drive system for driving rotation of the outer bowl and the inner rotor for common rotation in the same direction;

the drive system providing a differential in rotational speed between the outer wall of the inner rotor and the inner surface of the peripheral wall of the outer bowl such that the outer wall moves angularly relative to the inner surface of the peripheral wall;

the outer wall of the rotor being spaced radially inwardly of the inner surface of the bowl so as to define a space therebetween within which the slurry is separated;

a helical auger flight carried on the outer wall of the rotor having an outer edge of the auger flight which moves relative to the inner surface of the peripheral wall so as to tend to carry particulates collecting on the inner surface of the peripheral wall in a direction toward the first end of the bowl and the first discharge arrangement located at the first end;

the helical auger flight having openings therein allowing movement of the slurry in the space through the openings toward the second end of the bowl;

the bowl and the inner rotor each including a tapered portion such that the outer wall of the rotor and the inner surface of the bowl reduce in diameter toward the first end;

the rotor having a slurry inlet opening at the first end of the rotor into a feed chamber within the outer wall of the rotor;

a slurry inlet duct for transporting the slurry through the first end of the bowl into the inlet opening in the first end of the rotor;

the rotor having at least two outlet openings defined in the outer wall at angularly spaced positions around the axis to allow the slurry to exit through the outer wall from the feed chamber into the space;

the outlet openings each having a first side edge and a second side edge with the first and second side edges being generally parallel to each other and to the axis;

the rotor having an end accelerator plate of the feed chamber mounted within the outer wall of the rotor for rotation therewith;

the end accelerator plate lying generally in a radial plane of the axis such that the slurry flowing generally axially into the feed chamber contacts the accelerator plate of the rotor and moves radially outwardly therefrom through the at least two outlet openings into the space;

the end accelerator plate being connected to the outer wall of the rotor at an end edge of each of the at least two outlet openings in the outer wall;

at least two discharge surfaces within the feed chamber, each discharge surface having first and second end edges connected to the outer wall;

the discharge surfaces each being arranged generally at right angles to the end accelerator plate;

with the first edge of a respective one of the discharge surfaces being located at and connected to the first edge of a respective one of the outlet openings in the outer wall and with the second edge of the respective one of the discharge surfaces being located at and connected to the second edge of the next outlet opening in the outer wall so that the respective one of the discharge surfaces bridges a space therebetween;

wherein the auger flight has a pitch spacing at a portion of the outer wall of the rotor at the outlet openings which is greater than a pitch spacing at an end of the rotor remote from the slurry inlet opening.

2. The centrifuge according to claim 1 wherein each discharge surface being shaped, relative to an imaginary plane joining the first edge of a respective one of the outlet openings and the second edge of the next outlet opening, such that a portion of the discharge surface, which portion extends along the outlet opening and which portion lies adjacent the second edge of said next outlet, extends outwardly from the imaginary plane toward the first side edge of the next adjacent outlet opening.

3. The centrifuge according to claim 2 wherein the portion of the discharge surface is smoothly curved in cross-section taken in a radial plane of the axis.

4. The centrifuge according to claim 2 wherein the portion of the discharge surface has an apex which is at a maximum spacing from the imaginary plane where the apex is spaced from the second edge of the next adjacent outlet and the surface tapers back toward the imaginary plane as it approaches the second edge.

5. The centrifuge according to claim 2 wherein the portion of the discharge surface where the surface extends outwardly has a width in the direction between the second edge and the first edge which extends about half way across the imaginary plane.

6. The centrifuge according to claim 2 wherein each discharge surface is shaped, relative to the imaginary plane, such that a portion of the discharge surface adjacent the first edge of said one of the outlets lies generally in the imaginary plane.

7. A centrifuge for separation of particulates from a slurry containing the particulates in a liquid comprising:

an outer bowl having a longitudinal axis and a peripheral wall surrounding the axis, the peripheral wall extending from a first end of the bowl to a second opposed end of the bowl;

a first discharge arrangement at the first end of the bowl for discharge of the particulates;

a second discharge arrangement at the second end of the bowl for discharge of the slurry with the particulates removed;

a support assembly mounting the outer bowl for rotation about the longitudinal axis such that the particulates in the slurry within the bowl tend to move radially outwardly of the axis toward an inner surface of the peripheral wall;

an inner rotor mounted coaxially within the outer bowl for rotation of an outer wall of the inner rotor about the longitudinal axis, the rotor extending along the bowl from a first end of the rotor adjacent the first end of the bowl to a second end of the rotor adjacent the second end of the bowl;

a drive system for driving rotation of the outer bowl and the inner rotor for common rotation in the same direction;

the drive system providing a differential in rotational speed between the outer wall of the inner rotor and the inner surface of the peripheral wall of the outer bowl such that the outer wall moves angularly relative to the inner surface of the peripheral wall;

the outer wall of the rotor being spaced radially inwardly of the inner surface of the bowl so as to define a space therebetween within which the slurry is separated;

a helical auger flight carried on the outer wall of the rotor having an outer edge of the auger flight which moves relative to the inner surface of the peripheral wall so as to tend to carry particulates collecting on the inner surface of the peripheral wall in a direction toward the first end of the bowl and the first discharge arrangement located at the first end;

the helical auger flight having openings therein allowing movement of the slurry in the space through the openings toward the second end of the bowl;

the bowl and the inner rotor each including a tapered portion such that the outer wall of the rotor and the inner surface of the bowl reduce in diameter toward the first end;

the rotor having a slurry inlet opening at the first end of the rotor into a feed chamber within the outer wall of the rotor;

a slurry inlet duct for transporting the slurry through the first end of the bowl into the inlet opening in the first end of the rotor;

the rotor having a plurality of angularly spaced cutlet openings defined in the outer wall at angularly spaced positions around the axis each communicating with the feed chamber to allow the slurry to exit through the outer wall from the feed chamber into the space;

the plurality of outlet openings each having a first side edge and a second side edge with the first and second side edges being generally parallel to each other and to the axis so as to define a plurality of imaginary planes each joining the first edge of one outlet opening and the second edge of a next adjacent outlet opening;

the rotor having an end accelerator plate of the feed chamber mounted within the outer wall of the rotor for rotation therewith;

the end accelerator plate lying generally in a radial plane of the axis such that the slurry flowing generally axially into the feed chamber contacts the accelerator plate of the rotor and moves radially outwardly therefrom through the plurality of outlet openings into the space;

the end accelerator plate lying generally in a radial plane of the axis such that the slurry flowing generally axially into the feed chamber contacts the accelerator plate of the rotor and moves radially outwardly therefrom through the pluralty of outlet openings into the space;

the end accelerator plate being connected to the outer wall of the rotor at an end edge of each of the plurality of outlet openings in the outer wall;

a plurality of discharge surfaces within the feed chamber, each discharge surface having first and second end edges connected to the outer wall;

the discharge surfaces each being arranged generally at right angles to the end accelerator plate;

with the first edge of a respective one of the discharge surfaces being located at and connected to the first edge of a respective one of the outlet openings in the outer wall and with the second edge of the respective one of the discharge surfaces being located at and connected to the second edge of the next outlet opening in the outer wall so that the respective one of the discharge surfaces bridges a space therebetween;

each discharge surface being shaped, relative to an imaginary plane joining the first edge of a respective one of the outlet openings and the second edge of the next outlet opening, such that a portion of the discharge surface, which portion extends along the outlet opening and which portion lies adjacent the first edge of said, one of said outlet openings extends outwardly from the imaginary plane toward the second side edge of said one of the outlet openings;

wherein the portion of the discharge surface has an apex which is at a maximum spacing from the imaginary plane where the apex is spaced from the first edge of said one of the outlet openings and the surface tapers back toward the imaginary plane as it approaches the first edge;

and wherein the portion of the discharge surface is smoothly curved in cross-section taken in a radial plane of the axis.

8. The centrifuge according to claim 7 wherein the portion of the discharge surface has a width which extends about half way across the imaginary plane.

9. The centrifuge according to claim 7 wherein each discharge surface is shaped, relative to the imaginary plane, such that a portion of the discharge surface adjacent the second edge of said next adjacent one of the outlets lies generally in the imaginary plane.

10. A centrifuge for separation of particulates from a slurry containing the particulates in a liquid comprising:

an outer bowl having a longitudinal axis and a peripheral wall surrounding the axis, the peripheral wall extending from a first end of the bowl to a second opposed end of the bowl;

a first discharge arrangement at the first end of the bowl for discharge of the particulates;

a second discharge arrangement at the second end of the bowl for discharge of the slurry with the particulates removed;

a support assembly mounting the outer bowl for rotation about the longitudinal axis such that the particulates in the slurry within the bowl tend to move radially outwardly of the axis toward an inner surface of the peripheral wall;

an inner rotor mounted coaxially within the outer bowl for rotation of an outer wall of the inner rotor about the longitudinal axis, the rotor extending along the bowl from a first end of the rotor adjacent the first end of the bowl to a second end of the rotor adjacent the second end of the bowl;

a drive system for driving rotation of the outer bowl and the inner rotor for common rotation in the same direction;

the drive system providing a differential in rotational speed between the outer wall of the inner rotor and the inner surface of the peripheral wall of the outer bowl such that the outer wall moves angularly relative to the inner surface of the peripheral wall;

the outer wall of the rotor being spaced radially inwardly of the inner surface of the bowl so as to define a space therebetween within which the slurry is separated;

a helical auger flight carried on the outer wall of the rotor having an outer edge of the auger flight which moves relative to the inner surface of the peripheral wall so as to tend to carry particulates collecting on the inner surface of the peripheral wall in a direction toward the first end of the bowl and the first discharge arrangement located at the first end;

the helical auger flight having openings therein allowing movement of the slurry in the space through the openings toward the second end of the bowl;

the bowl and the inner rotor each including a tapered portion such that the outer wall of the rotor and the inner surface of the bowl reduce in diameter toward the first end;

the rotor having a slurry inlet opening at the first end of the rotor into a feed chamber within the outer wall of the rotor;

a slurry inlet duct for transporting the slurry through the first end of the bowl into the inlet opening in the first end of the rotor;

the rotor having a first and a second angularly spaced outlet opening defined in the outer wall at diagonally opposed positions around the axis each communicating with the feed chamber to allow the slurry to exit through the outer wall from the feed chamber into the space;

the first and second outlet openings each having a first side edge and a second side edge with the first and second side edges being generally parallel to each other and to the axis;

the rotor having an end accelerator plate of the feed chamber mounted within the outer wall of the rotor for rotation therewith;

the end accelerator plate lying generally in a radial plane of the axis such that the slurry flowing generally axially into the feed chamber contacts the accelerator plate of the rotor and moves radially outwardly therefrom through the first and second outlet openings into the space;

the end accelerator plate being connected to the outer wall of the rotor at an end edge of each of the first and second outlet openings in the outer wall;

each of the first and second outlet openings having a first edge and a second edge so as to define a first imaginary plane joining the first edge of the first outlet opening and the second edge of the second outlet opening and a second imaginary plane joining the second edge of the first outlet opening and the first edge of the second outlet opening;

a first and a second discharge surfaces within the feed chamber, each discharge surface having first and second end edges connected to the outer wall;

the first and second discharge surfaces each being arranged generally at right angles to the end accelerator plate;

with the first edge of the first discharge surface being located at and connected to the first edge of the first outlet opening in the outer wall and with the second edge of the first discharge surface being located at and connected to the second edge of the second outlet opening in the outer wall so that the first discharge surface bridges a space therebetween;

with the first edge of the second discharge surface being located at and connected to the first edge of the second outlet opening in the outer wall and with the second edge of the second discharge surface being located at and connected to the second edge of the first outlet opening in the outer wall so that the second discharge surface bridges a space therebetween;

the first discharge surface being shaped relative to the first imaginary plane such that a portion of the first discharge surface, which portion extends along the first outlet opening and which portion lies adjacent the first edge of the first outlet opening, extends outwardly from the first imaginary plane toward the second imaginary plane;

the second discharge surface being shaped such that a portion of the second discharge surface, which portion extends along the second outlet opening and which portion lies adjacent the first edge of the second outlet opening, extends outwardly from the second imaginary plane toward the first imaginary plane;

wherein the portion of the first discharge surface has an apex which is at a maximum spacing from the first imaginary plane where the apex is spaced from the first edge of the first outlet opening and the surface tapers back toward the first imaginary plane as it approaches the first edge of the first outlet opening;

the portion of the second discharge surface has an apex which is at a maximum spacing from the second imaginary plane where the apex is spaced from the first edge of the second outlet opening and the surface tapers back toward the second imaginary plane as it approaches the first edge of the second outlet opening;

wherein the portion of the first discharge surface is smoothly curved in cross-section taken in a radial plane of the axis;

and wherein the portion of the second discharge surface is smoothly curved in cross-section taken in a radial plane of the axis.

11. The centrifuge according to claim 10 wherein the portion of the first discharge surface has a width which extends about half way across the first imaginary plane and the portion of the second discharge surface has a width which extends about half way across the second imaginary plane.

12. The centrifuge according to claim 10 wherein the first discharge surface is shaped, relative to the first imaginary plane, such that a portion of the first discharge surface adjacent the second edge of the second outlet opening lies generally in the first imaginary plane and the second discharge surface is shaped, relative to the second imaginary plane, such that a portion of the second discharge surface adjacent the second edge of the first outlet opening lies generally in the second imaginary plane.

13. The centrifuge according to claim 10 wherein the auger flight has a pitch spacing at a portion of the outer wall of the rotor at the outlet openings which is greater than a pitch spacing at an end of the rotor remote from the slurry inlet opening.

* * * * *